US005612724A

United States Patent [19]

Murakami et al.

[11] Patent Number: 5,612,724

[45] Date of Patent: Mar. 18, 1997

[54] INK JET RECORDING HEAD WITH ENHANCED BONDING FORCE BETWEEN A HEAT STORING LAYER AND SUBSTRATE, A METHOD OF FORMING THE SAME AND A RECORDING APPARATUS HAVING SAID RECORDING HEAD

[75] Inventors: Keiichi Murakami, Hachioji; Hirokazu Komuro, Yokohama, both of Japan

[73] Assignee: Canon Kabushiki Kaisha, Tokyo, Japan

[21] Appl. No.: 46,136

[22] Filed: Apr. 15, 1993

[30] Foreign Application Priority Data

Apr. 16, 1992 [JP] Japan ..... 4-096492
Jun. 8, 1992 [JP] Japan ..... 4-147676

[51] Int. Cl.[6] ..... B41J 2/05

[52] U.S. Cl. ..... 347/64

[58] Field of Search ..... 347/63, 64; 427/435, 427/437, 528, 531

[56] References Cited

U.S. PATENT DOCUMENTS

| | | | |
|---|---|---|---|
| 4,313,124 | 7/1982 | Hara | 346/140 R |
| 4,330,787 | 5/1982 | Sato et al. | 347/63 |
| 4,345,262 | 8/1982 | Shirato et al. | 346/140 R |
| 4,392,907 | 7/1983 | Shirato et al. | 347/63 |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,904,542 | 2/1990 | Mroczkowski | 428/610 |
| 4,970,532 | 11/1990 | Komuro et al. | 346/140 |

FOREIGN PATENT DOCUMENTS

| | | |
|---|---|---|
| 0318981 | 6/1989 | European Pat. Off. . |
| 0332764 | 9/1989 | European Pat. Off. . |
| 0400997 | 12/1990 | European Pat. Off. . |
| 0428730 | 5/1991 | European Pat. Off. . |
| 54-51837 | 4/1979 | Japan . |
| 54-56847 | 5/1979 | Japan . |
| 59-138461 | 5/1979 | Japan . |
| 59-123670 | 7/1984 | Japan . |
| 60-71260 | 4/1985 | Japan . |

OTHER PUBLICATIONS

IBM Technical Disclosure Bulletin, "Process for forming tab contact pads, alignment guides and ink flow channels for thermal ink jet print heads", vol. 34, No. 7B, New York US, pp. 266–269, (Dec. 1991).

Chang et al, "Factors influencing the lifetime of thermal ink–jet heaters", Proceedings of the SID, vol. 28, No 4, New York USA, pp. 477–482, (1987).

Jou et al, "An analysis of thermal stresses in a multilayer thin film printhead", Thin Solid Films, vol. 201, No. 2, Lausanne CH, pp. 253–265, (Jun. 30, 1991).

*Primary Examiner*—Valerie Lund

*Attorney, Agent, or Firm*—Fitzpatrick, Cella, Harper & Scinto

[57] ABSTRACT

An ink jet recording head comprising energy generating elements for applying the heat energy to the ink, heat acting portions for forming bubbles in the ink with said energy generating elements, a heat storing layer having insulating property for storing the heat energy disposed adjacent to said energy generating elements, and a support substrate for supporting said heat storing layer, characterized in that said support substrate is composed mainly of metal, and said heat storing layer is a chemical conversion coating which is formed through chemical treatment of the surface of said substrate.

7 Claims, 5 Drawing Sheets

INK JET RECORDING HEAD WITH ENHANCED BONDING FORCE BETWEEN A HEAT STORING LAYER AND SUBSTRATE, A METHOD OF FORMING THE SAME AND A RECORDING APPARATUS HAVING SAID RECORDING HEAD

BACKGROUND OF THE INVENTION

1. Field of the Invention

The present invention relates to an ink jet recording head in which ink droplets are formed by jetting the ink through ink discharge orifices.

2. Related Background Art

An ink jet recording head of this type was described in, for example, Japanese Laid-open Patent Application No. 54-51837, wherein an ink jet recording method thereof has a different feature from other ink jet recording methods in that the motive force for the discharge of ink droplets is obtained by applying heat energy to the ink.

The recording method as disclosed in the above application is characterized in that the ink subjected to the heat energy is heated to produce bubbles adhering to a recording medium to record the information.

A recording head according to this recording method generally comprises ink discharge orifices provided to discharge ink droplets, liquid channels in communication with ink discharge orifices, each having a heat acting portion in which the heat energy useful for the discharge of ink droplets acts on the ink, a heat generating resistive layer for use as electricity-heat converters which is generating means of the heat energy, an upper protective layer for protecting the heat generating resistive layer from the ink as well as a heat storing layer for storing the heat energy, and a support substrate for supporting the whole recording head. Note that the upper protective layer may be omitted.

The heat storing layer, which is provided bwtween the substrate, and the heat generating resistive layer, requires the insulating property particularly when the substrate is electrically conductive. Typically, the heat storing layer is formed by covering the surface of the substrate with an insulating material.

Herein, it is noted that the heat storing layer also serving as an insulation layer requires a poor heat conductivity and an insulating property. Also, it must withstand high temperatures above 600° C., which is a temperature of the heat generating resistive layer when energized, as it will be placed adjacent the heat generating resistive layer to prevent heat radiation to the support substrate. Further, it requires to have an excellent surface property, because it has some influence on the surface property of the heat acting portion which causes ink bubbles to be produced.

Accordingly, an inorganic insulating material, as the material for the heat storing layer meeting the above requirements, has been formed as the film on the surface of the substrate, by chemical vapor phase reaction such as CVD, or vacuum film formation such as PVD.

On the other hand, the material for forming the support substrate on which such heat storing layer is formed as the film, includes preferably those having a great heat conductivity and an excellent surface property, for which a silicone substrate has been conventionally used. However, since the silicone substrate is expensive, and unfavorable in the respect of industrial economy, numerous inexpensive alternative materials have been examined. Thus, inexpensive metallic substrates with great heat conductivity and excellent surface property have been noted. Among them, aluminum which is cheap and has a great heat conductivity has been particularly noted.

However, when the heat storing layer having a thickness of 1.0 μm or more was formed as the film on the metallic substrate by CVD or PVD as above cited, there often occurred some peeling of the heat storing layer from the substrate. When the film thickness is below 1.0 μm, no peeling of the heat storing layer occurs, but the heat storing layer for use with the ink jet recording head as previously described requires a thickness of 1.0 μm or more, preferably, about 3.0 μm, for the purpose of heat storage. Therefore, it was sought that the heat storing layer having a relatively great thickness was constituted so as not to cause any peeling.

The present inventors have discovered as a result of effortful researches that the substrate temperature when forming the film of heat storing layer may have some effects on the peeling of the heat storing layer. That is, when an inorganic insulating material is formed as the film on the metallic substrate by CVD or PVD, the substrate temperature in forming the film is as high as from about 200° C. to 600° C., and when the temperature is decreased from this state down to room temperature, there will occur remarkably a stress due to a difference between thermal expansion coefficients of the metallic substrate and the heat storing layer of inorganic insulating material, because the thermal expansion coefficient of the metallic substrate is larger than that of the silicone substrate. And when this stress becomes larger than a bonding force between the support substrate and the heat storing layer, a peeling of the heat storing layer will occur. In particular, this stress becomes greater with a larger film thickness of the heat storing layer. This phenomenon will occur on almost all the metallic substrates.

Also, the peeling of the heat storing layer due to this thermal stress can also occur when an ink jet recording head having a plurality of energy elements arranged at high density is continuously driven.

A solution for the above problem includes decreasing the substrate temperature when forming the film of heat storing layer, but is unfavorable because if film formation is made at low temperatures, the film quality may degrade such as lower dielectric strength.

Also, no formation materials of the heat storing layer are currently found which meet the insulating property, low heat conductivity, and heat resistance, as well as having a heat expansion coefficient equivalent to that of metal.

SUMMARY OF THE INVENTION

The present invention relies on the relationship of a bonding force between a support substrate and an insulation layer relative to a thermal stress between the support substrate and the insulation layer, and provides an ink jet recording head having an excellent print characteristic by preventing the peeling of a heat storing layer in such a way that the bonding force may be larger than the thermal stress without decreasing the substrate temperature in forming the heat storing layer and other layers.

It is a principal object of the present invention to provide an ink jet recording head comprising energy generating elements for applying the heat energy to the ink, heat acting portions for forming bubbles in the ink with said energy generating elements, a heat storing layer having the insulating property for storing the heat energy disposed adjacent to said energy generating elements, and a support substrate for supporting said heat storing layer, characterized in that said support substrate is composed mainly of metal, and said heat storing layer is a chemical conversion coating which is formed through chemical treatment of the surface of said substrate.

It is another object of the present invention to provide an ink jet recording head comprising energy generating elements for applying the heat energy to the ink, heat acting portions for forming bubbles in the ink with said energy generating elements, a heat storing layer having the insulating property for storing the heat energy disposed adjacent to said energy generating elements, and a support substrate for supporting said heat storing layer, characterized in that said support substrate is composed mainly of metal, and said heat storing layer is formed by ion implantation.

It is a further object of the present invention to provide an ink jet recording head comprising energy generating elements for applying the heat energy to the ink, heat acting portions for forming bubbles in the ink with said energy generating elements, a heat storing layer having the insulating property for storing the heat energy disposed adjacent to said energy generating elements, and a support substrate for supporting said heat storing layer, characterized in that said support substrate is composed mainly of metal, and a stress relief layer is provided between said support substrate and said heat storing layer.

It is a still further object of the present invention to provide an ink jet recording head comprising energy generating elements for applying the heat energy to the ink, heat acting portions for forming bubbles in the ink with said energy generating elements, a heat storing layer having the insulating property for storing the heat energy disposed adjacent to said energy generating elements, and a support substrate for supporting said heat storing layer, characterized in that said support substrate is composed mainly of metal, and said heat storing layer contains at least a material constituting said support substrate.

DESCRIPTION OF THE PREFERRED EMBODIMENTS

Figure 1:
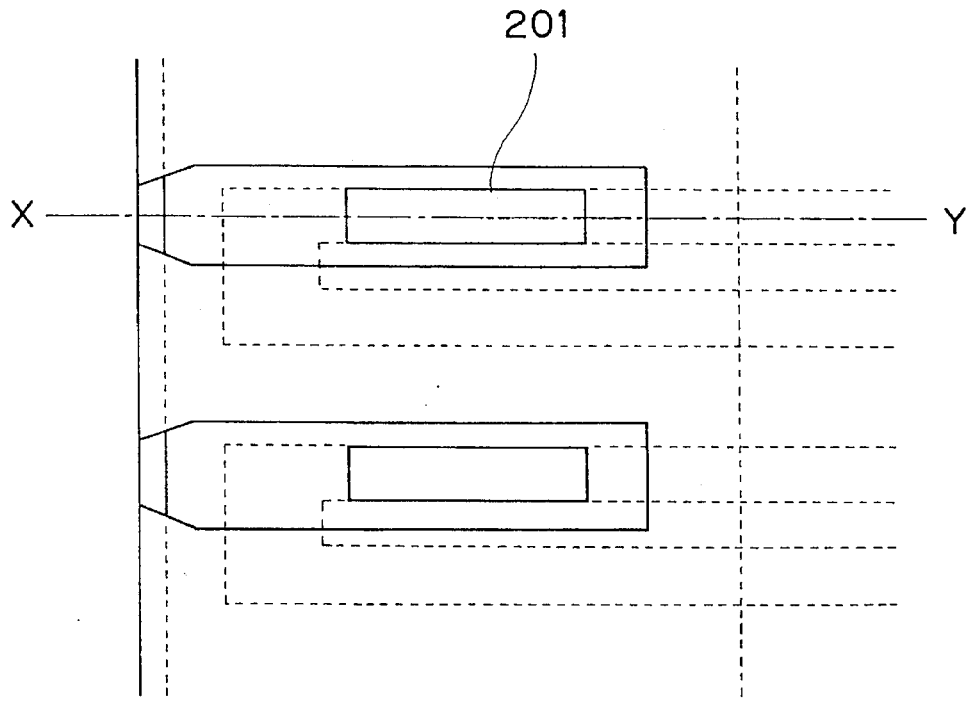
FIG. 1 is an enlarged plan view showing an embodiment around a heater board of an ink jet recording head.

The present invention will be described in detail in the following.

The present invention relies on the relationship of a bonding force between the heat storing layer and the substrate relative to the thermal stress, so that the bonding force may be larger than the thermal stress.

Specifically, the bonding force is enhanced so as not to be inferior to the thermal stress of metallic substrate, and the present inventors have first paid attention to a contact interface between the metallic substrate and the heat storing layer. Herein, it is noted that the property required for the metallic substrate to enhance the bonding force involves an excellent surface property. This property is also required in that the surface property will have influence on the heat acting portion, like the heat storing layer. That is, the bonding force will be enhanced with a smaller gap of the interface. And the inventors have led to a view of improving the surface property of the metallic substrate to form the heat storing layer in order to eliminate this gap of the interface. Typically, an insulating material can be made by oxidizing and nitriding the metal. Because by forming this insulating material as the heat storing layer, the gap of the interface between the substrate and the heat storing layer can be eliminated, the bonding force is enhanced, so that it is possible to prevent the peeling of the heat storing layer even when there may occur a great thermal stress on the metallic substrate.

It should be noted that the present invention utilizes the following two methods for improving the surface property of the metallic substrate.

First, a first recording head of the present invention has a heat storing layer covered with a chemical conversion coating which is made by immersing the substrate in a chemical conversion treatment solution and oxidizing its surface. Such chemical conversion treatment solution and method includes Alodine method of using an acid solution containing chromate, phosphate and fluoride, MBV (Modifzierte Bauer Vogel) method of using an aqueous solution of sodium carbonate anhydride and sodium chromate anhydride, or EW (Erift Werk) method of using an aqueous solution of sodium carbonate, sodium chromate and sodium silicate.

And a second recording head of the present invention, conforming to the first recording head of the invention, has its heat storing layer formed on the support substrate by ion implantation. Specifically, oxygen ions ($O^+$) or nitrogen ions ($N^+$) are implanted into the substrate at an injection energy of 20 keV to 400 keV, with an implanted ion amount of $1\times10^{16}$ to $1\times10^{19}$ ions/cm$^2$, by an ion implanter. To recover defects, heat treatment may be performed after implantation.

By the way, when the heat storing layer is formed by improving the surface of the metallic substrate as above described, the material of the heat storing layer is determined by the material of the substrate. That is, when using a material having superior performance as the heat storing layer, the above-cited methods cannot be used.

Thus, the present inventors have examined a method which allows the heat storing layer to be made of any material irrespective of the substrate material, and created the following recording heads.

A third recording head of the present invention involves a heat storing layer having its composition ratio gradually changing from the support substrate to the heat generating resistive layer, or from the composition near the support substrate material to inorganic insulating material such as $SiO_2$. This change may occur at steps, or continuously.

This recording head is, in view of the variation in adherence depending on the material, to improve the bonding force between the substrate and the heat storing layer by bonding the layers made of as similar materials to each other as possible on the interfaces from the substrate to the heat storing layer, thereby coping with the thermal stress of the metallic substrate.

In this way, by changing the composition of the heat storing layer in a normal direction of the film formation face as above described, it is possible to prevent the peeling of the heat storing layer which would be caused by the stress produced due to the difference between thermal expansion coefficients of the support substrate and the heat storing layer on the interface thereof.

The thickness of the heat storing layer is determined by the heat conductivity, in which the change of the heat conductivity depending on the material should be taken into consideration, but when the composition ratio continuously changes, the heat conductivity is unknown, whereby it is preferable that the thickness of the material making up the heat storing layer is considered as that of the heat storing layer.

And when the composition of the heat storing layer changes at steps, in consideration of the adherence between layers, it is preferable that respective layers of the heat storing layer contain 50% or more of the constitution of adjacent layer.

The present inventors have further produced the following recording head in view of the thermal stress itself which is produced by the metallic substrate.

A fourth recording head of the present invention is provided with a stress relief layer between the metallic substrate and the heat storing layer.

This stress relief layer is to relieve the strain caused by the thermal stress between the metallic substrate and the heat storing layer, and preferable materials thereof include a heat resistant resin having a heat resistance to withstand the film formation temperature of the heat storing layer, heater, electrode, and protective layer, and a low Young's modulus. Further specifically, polyimide, polyamide, and epoxy are included. Herein, the Young's modulus means a ratio of the strain to the load, in which typically, the Young's modulus of metal or inorganic compound is 1 to $20\times10^{10}$ Pa, while that of the resin is 0.1 to $0.01\times10^{10}$ Pa.

The present invention has in practice a residual stress left in the metallic substrate, owing to a small strain caused by the load (shrinkage force of the metallic substrate), because the stress relief layer made of a material having a low Young's modulus is sandwiched between the substrate and the heat storing layer.

In the fourth recording head of the present invention, since the bonding condition between the metal and the resin is essentially excellent in most cases, it is considered that the metallic substrate and the stress relief layer are not peeled. Hence, the peeling may possibly take place in the region between the heat storing layer (inorganic compound) and the stress relief layer (resin) which often lies in relatively poor bonding condition, but there is no problem with such peeling because the bonding condition can be improved by the addition of silane agent, as required.

Note that the film formation condition of the stress relief layer is preferably such that the substrate temperature is from 100° to 400° C., and the film thickness is from 0.2 to 1.0 μm.

This is based on the fact that the heat radiation will decrease if the film thickness is too large, due to low heat conductivity of resin making upon the stress relief layer.

The fourth ink jet recording head of the present invention adopting the above-described constitution can prevent the peeling of the heat storing layer by virtue of the stress relief layer, as well as rendering the warp of the substrate after film formation of the heat storing layer almost ignorable, even if there occurs a stress due to the difference between thermal expansion coefficients of the support substrate and the heat storing layer. Herein, almost ignorable means a degree of warpage equivalent to the warpage of the substrate in the recording head using a conventional silicone substrate, and causing no problem to the recording head in the manufacturing process or after manufacture.

Further, by adopting the stress relief layer, it is possible to manufacture an ink jet recording head capable of making excellent printing, without producing any warp in the substrate, after forming the heat generating resistive layer, the electrode layer and upper protective layer, following the heat storing layer.

Figure 8:
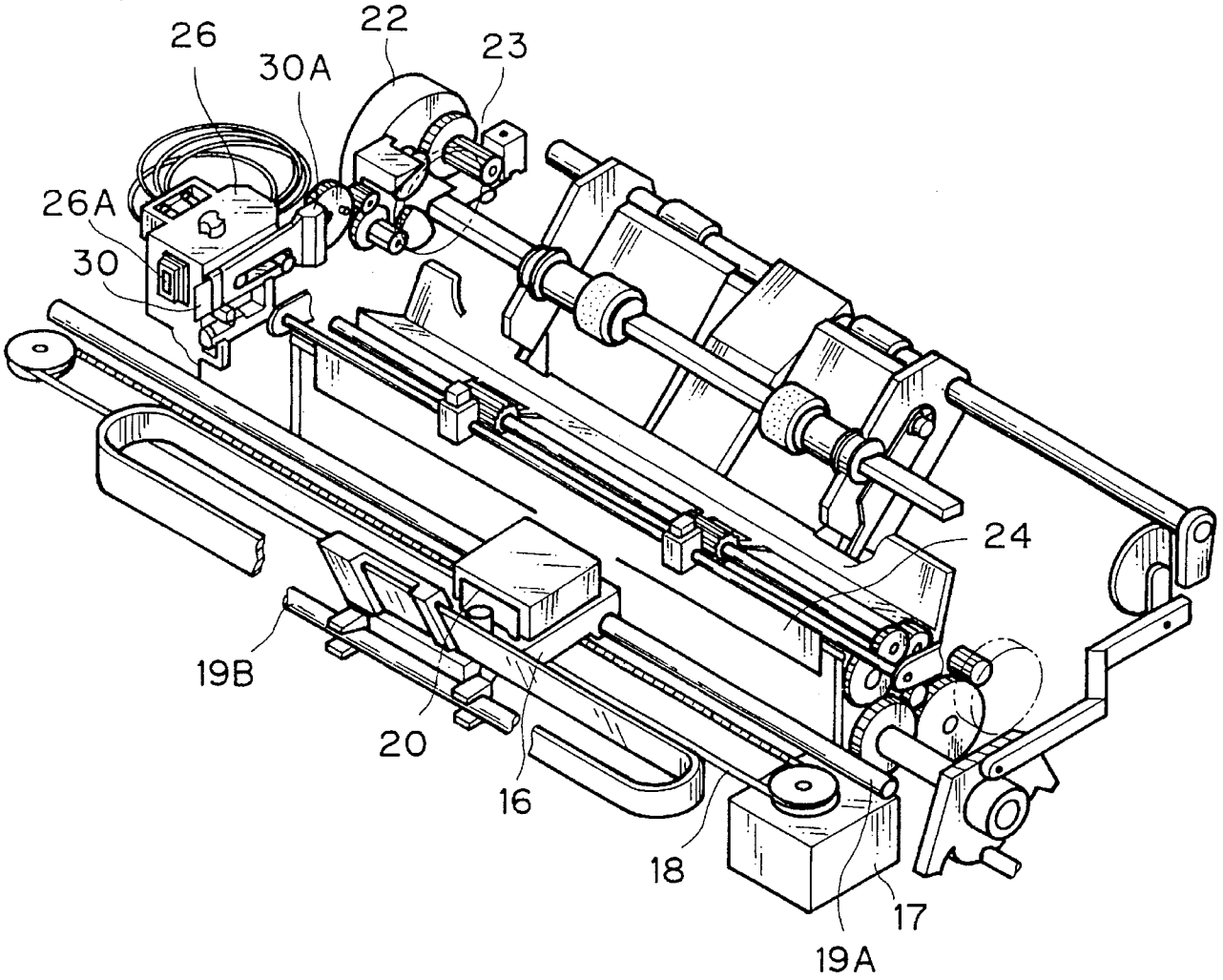
FIG. 8 is a perspective view of a recording apparatus with a recording head according to the present invention.

FIG. 8 is an external appearance view showing an embodiment of an ink jet recording apparatus (IJRA) having a recording head according to the present invention mounted as an ink jet head cartridge (IJC).

In the figure, 20 is an ink jet head cartridge (IJC) having a group of nozzles for discharging the ink which are placed opposed to the recording face of a recording sheet supplied onto a platen 24. 16 is a carriage HC for carrying the IJC 20, which connects to a part of a driving belt 18 for transmitting the driving force of a driving motor 17 in such a way as to be slidable on two guide shafts 19A and 19B disposed in parallel to each other, so that the IJC 20 can reciprocate over the entire width of the recording sheet.

26 is a head recovery device which is disposed at one end of the travel passage of the IJC 20, for example, at a position opposite a home position. The head recovery device 26 is operated by the drive force of a motor 22 via a transmission mechanism 23 to perform a capping of the IJC 20. In connection with the capping of the IJC 20 with a cap portion 26A of this head recovery device 26, the ink suction with appropriate suction means provided within the head recovery device 26, or the ink pressure feed with appropriate pressure means provided on an ink supply passage to the IJC 20 is performed to compulsorily discharge the ink through the discharge orifices to thereby make a discharge recovery processing such as removing thicker ink within nozzles. Also, by performing the capping when the recording is terminated, the IJC can be protected.

30 is a blade as a wiping member which is disposed on the side face of the head recovery device 26 and formed of silicone rubber. A blade 31 is held on a blade holding member 31A in cantilevered form, and operated by the motor 22 and the transmission mechanism 23, like the head recovery device 26, so that it is engageable with the discharge face of the IJC 20. Thereby, at appropriate timings in the recording operation of the IJC 20, or after the discharge recovery processing using the head recovery device 26, the blade 31 is projected into the travel passage of the IJC 20 to wipe off dewing, wetting or dusts on the discharge face of the IJC 20 along with the travel operation of the IJC 20.

In the following, the present invention will be described specifically by way of example.

EXAMPLE 1

Figure 2:
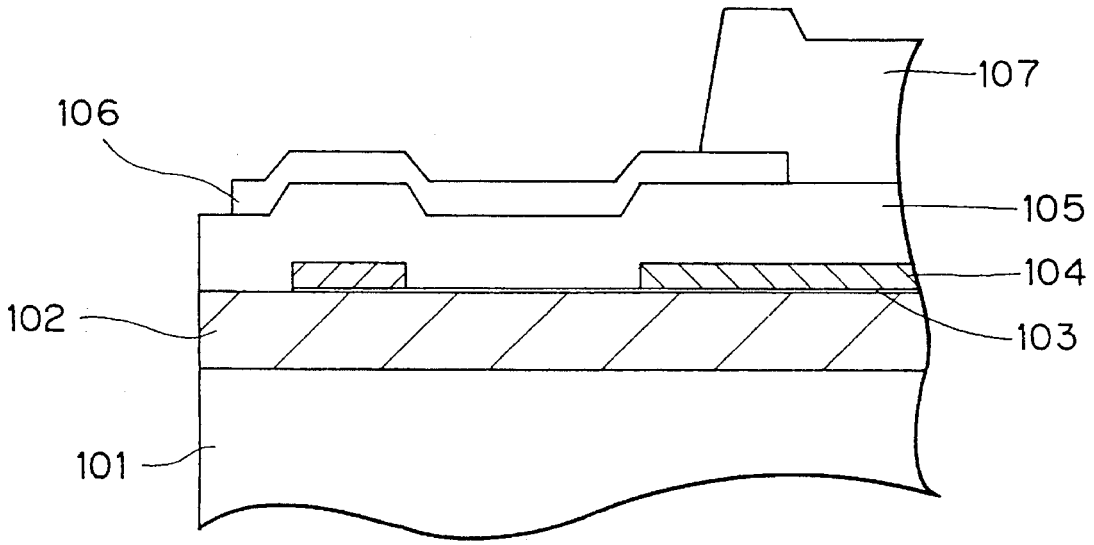
FIG. 2 is a cross-sectional view taken along the X-Y sectional line of FIG. 1, according to the first and second embodiments of the present invention.

An ink jet recording head as shown in FIGS. 1 and 2 was fabricated in the following way.

Figure 6:
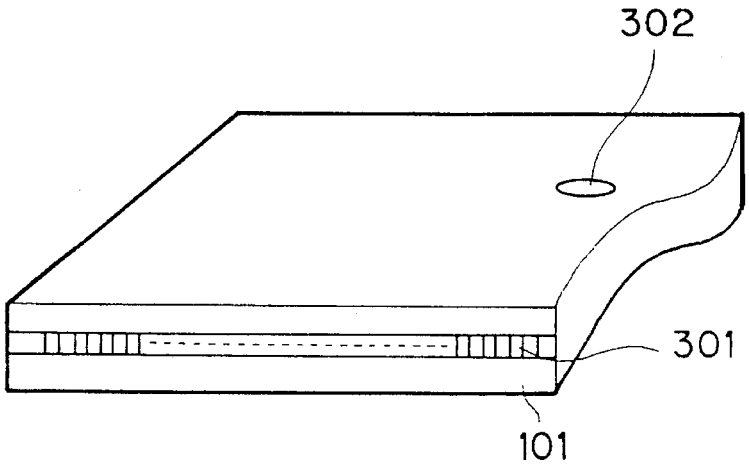
FIG. 6 is a perspective view showing an embodiment around the discharge orifices of an ink jet recording head according to the present invention.

A support substrate 101 made of 99.9% Al was prepared. On this substrate, a heat storing layer 102 was formed in a thickness of 3.0 μm under the conditions as indicated in Table 1 by Alodine method. Then, a heat generating resistive layer 103 was made by forming a film of $HfB_2$ in a thickness of 0.1 μm by sputtering. In this case, the sheet resistance was 18 Ω. Then, an electrode layer 104 was made by forming a film of Al by vapor deposition. Then, by photolithography technique, a circuit pattern as shown by the dashed lines in FIG. 1 was formed to make a heat acting portion 201 of 30 μm×150 μm. Further, a first protective layer 105 was made by forming a film of $SiO_2$ in a thickness of 1.0 μm at a substrate temperature of 350° C. by sputtering, and a second protective layer 106 was made by forming a film of Ta in a thickness of 0.5 μm at a substrate temperature of 100° C. by sputtering. Further, a third protective layer 107 was made by coating a photosensitive polyimide (Photoneath made by Toray Industries), then patterned and post-baked at 300° C. Using a heater board as created in the above way, the liquid channels and the ink discharge orifices were formed in the normal method, whereby an ink jet recording head having a recording width of 200 mm as shown in FIG. 6 was completed. In FIG. 6, 301 is an ink discharge orifice and 302 is an ink supply opening.

EXAMPLE 2

An ink jet recording head was fabricated in the same way as in the example 1, except that the heat storing layer was formed under the conditions as listed in Table 1 by MBV.

EXAMPLE 3

An ink jet recording head was fabricated in the same way as in the example 1, except that the heat storing layer was formed under the conditions as listed in Table 1 by EW.

EXAMPLE 4

An ink jet recording head was fabricated in the same way as in the example 1, except that the heat storing layer 102 was formed under the conditions as listed in Table 2 by ion implantation.

EXAMPLE 5

An ink jet recording head was fabricated in the same way as in the example 4, except that the substrate was made of 99% Cu.

EXAMPLES 6 and 7

Figure 3:
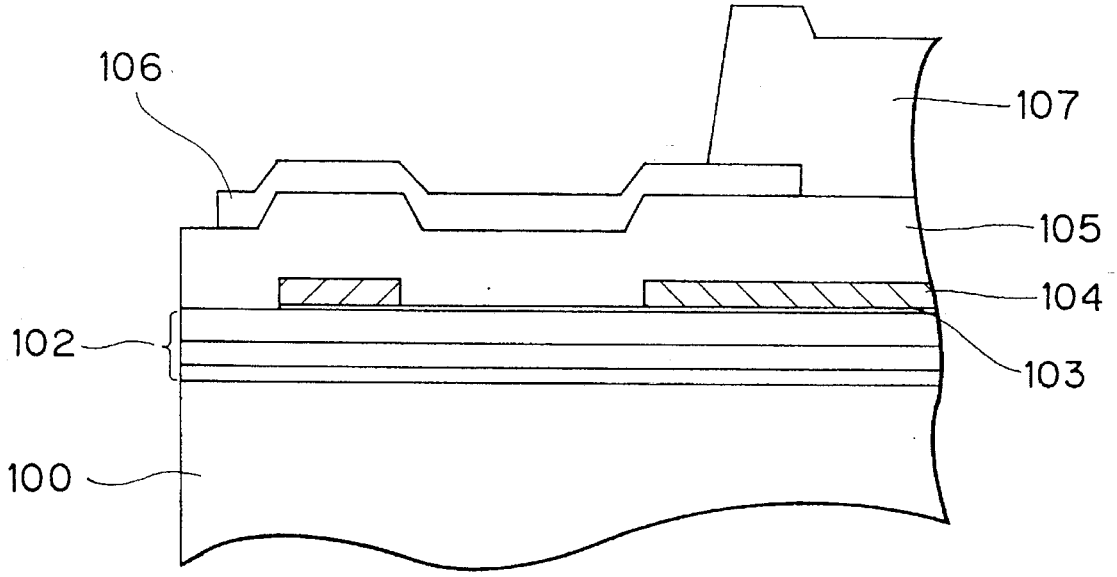
FIG. 3 is a cross-sectional view taken along the X-Y sectional line of FIG. 1, according to the third embodiment of the present invention.

An ink jet recording head as shown in FIGS. 1 and 3 was fabricated in the following way.

First, a support substrate 100 was prepared in a composition as listed in Table 3. Then, the heat storing layer 102 was made by forming a 3.0 μm thick film on the substrate at 300° C. under the conditions as listed in Table 3 by sputtering. Thereby, an ink jet recording head was fabricated in the same way as in the example 1, except for the above formation.

EXAMPLE 8

Figure 4:
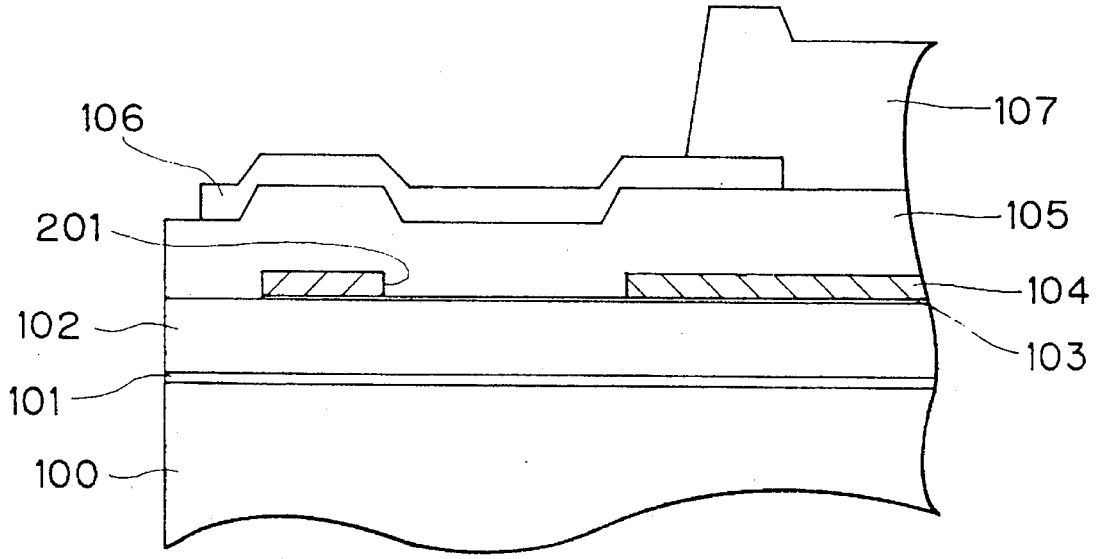
FIG. 4 is a cross-sectional view taken along the X-Y sectional line of FIG. 1, according to the fourth embodiment of the present invention.

An ink jet recording head as shown in FIGS. 1 and 4 was fabricated in the following way.

A support substrate 100 used aluminum of 99.9%. On that substrate, a stress relief layer 101 having a thickness of 0.2 μm was made by spin-coating polyimide (PIQ, made by Hitachi Chemical), and baking at 400° C. Then, at a substrate temperature of 350° C., a heat storing layer 102 was made by forming a film of $SiO_2$ in a thickness of 3.0 μm by sputtering.

Except for the above points, an ink jet recording head was fabricated in the same way as in the example 1.

EXAMPLES 9

An ink jet recording head was fabricated in the same way as in the example 8, except that the heat storing layer and the first protective layer used $Si_3N_4$.

COMPARATIVE EXAMPLES 1 to 4

Figure 5:
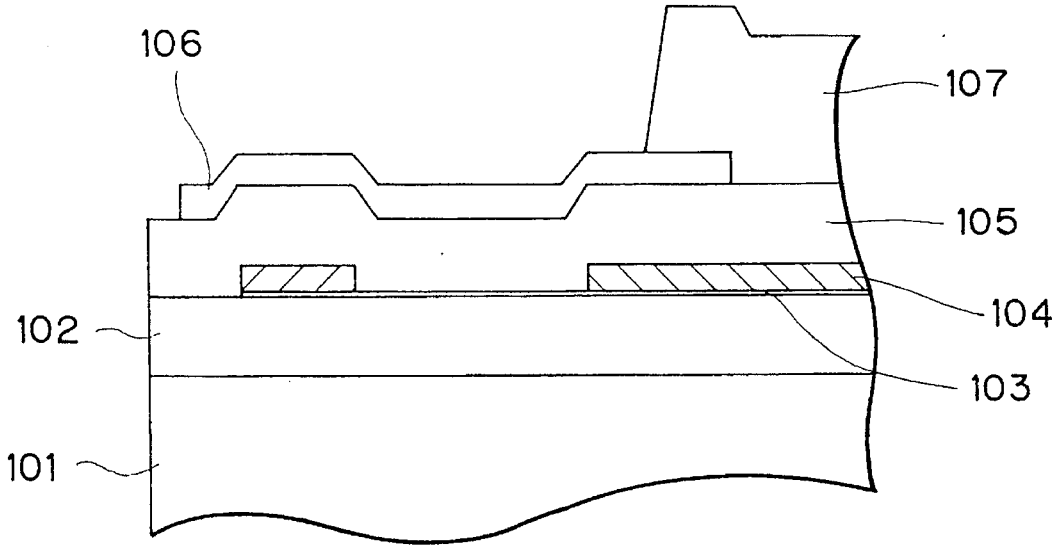
FIG. 5 is a cross-sectional view taken along the X-Y sectional line of FIG. 1, according to a conventional ink jet recording head.

As the comparative example, an ink jet recording head as shown in FIG. 5 was fabricated in the following way.

A support substrate 100 having a composition as indicated in Table 4 was prepared, and then a heat storing layer 102 was made by forming a film in a thickness of 3.0 μm on the substrate at 300° C. under the conditions as listed in Table 4 by sputtering.

Then, a heat generating resistive layer 103 was made by forming a film of $HfB_2$ in a thickness of 0.1 μm on the substrate by sputtering. The sheet resistance was 18 Ω in either of the examples and comparative examples. Then, an electrode layer 104 was made by forming a film of Al by vapor deposition. Further, by photolithography technique, a circuit pattern as shown in FIG. 1 was formed to make a heat acting portion 201 of 30 μm×150 μm. Then, a first protective layer 105 was made by forming a film of $SiO_2$ in a thickness of 1.0 μm by sputtering, and a second protective layer 106 was made by forming a film of Ta in a thickness of 0.5 μm by sputtering. Further, a third protective layer 107 was made by coating a photosensitive polyimide (Photoneath made by Toray Industries), then patterned and post-baked. Note that the comparative example 3 formed the first protective layer 105 using $Si_3N_4$ instead of $SiO_2$.

Using a heater board as created in the above way, the liquid channels and the ink discharge orifices were formed, whereby an ink jet recording head having a heat generating plane in the same direction as the ink discharge direction as shown in FIG. 6 was completed.

TABLE 1

| | Example 1 | Example 2 | Example 3 |
|---|---|---|---|
| Forming heat storing layer | Alodine Method | MBV method | EW method |
| Solution composition | 75% phosphoric acid ($H_2PO_4$) 64 g/l<br>sodium fluoride (NaF) 5 g/l<br>Chromic acid ($CrO_3$) 10 g/l | sodium hydroxide (NaOH) 5%<br>sodium chromate ($Na_2CrO_4$) 1.5% | sodium carbonate 51.3 g/l<br>sodium chromate 15.4 g/l<br>sodium silicate 0.07 g/l |
| Solution temperature | 50° C. | 96° C. | 95° C. |
| Immersion time | 30 min. | 60 min. | 90 min. |

TABLE 2

| | |
|---|---|
| Implanted ion species | $O^+$ |
| Implanted energy | 300 keV |
| Amount of implanted ions | $1 \times 10^{18}$ ions/cm$^2$ |

TABLE 3

| | Substrate | | Target 1 | | Target 2 | | Gas | Film forming |
|---|---|---|---|---|---|---|---|---|
| | Material | Process | material | power/kw | material | power/kw | pressure/$10^{-4}$ Pa | time/min |
| Ex. 6 | 99.9% Al | step 1 | $SiO_2$ | 0.5 | Al | 3.0 | 10 | 15 |
| | | step 2 | $SiO_2$ | 1.0 | Al | 1.0 | 10 | 15 |
| | | step 3 | $SiO_2$ | 2.0 | Al | 0 | 5 | 30 |
| Ex. 7 | 99% Cu | step 1 | $SiO_2$ | 0.3 | Cu | 4.0 | 15 | 10 |
| | | step 2 | SiO2 | 0.9 | Cu | 2.0 | 15 | 15 |
| | | step 3 | $SiO_2$ | 2.0 | Cu | 0 | 5 | 30 |

TABLE 4

| | Substrate | | Target 1 | | Target 2 | | Gas | Film forming |
|---|---|---|---|---|---|---|---|---|
| | Material | Process | material | power/kw | material | power/kw | pressure/$10^{-4}$ Pa | time/min |
| Comp. ex. 1 | 99.9% Al | — | $SiO_2$ | 2.0 | — | — | 5 | 50 |
| Comp. ex. 2 | 99% Cu | — | $SiO_2$ | 2.0 | — | — | 5 | 50 |
| Comp. ex. 3 | 99.9% Al | — | $Si_3N_4$ | 2.0 | — | — | 5 | 50 |
| Comp. ex. 4 | 99.9% Si | — | $SiO_2$ | 2.0 | — | — | 5 | 50 |

The ink jet recording heads in the examples 1 to 9 and the comparative examples 1 to 4 were observed visually or through a microscope to investigate the presence or absence of the support substrate and the heat storing layer, and their results are shown in Table 5.

Figure 7:
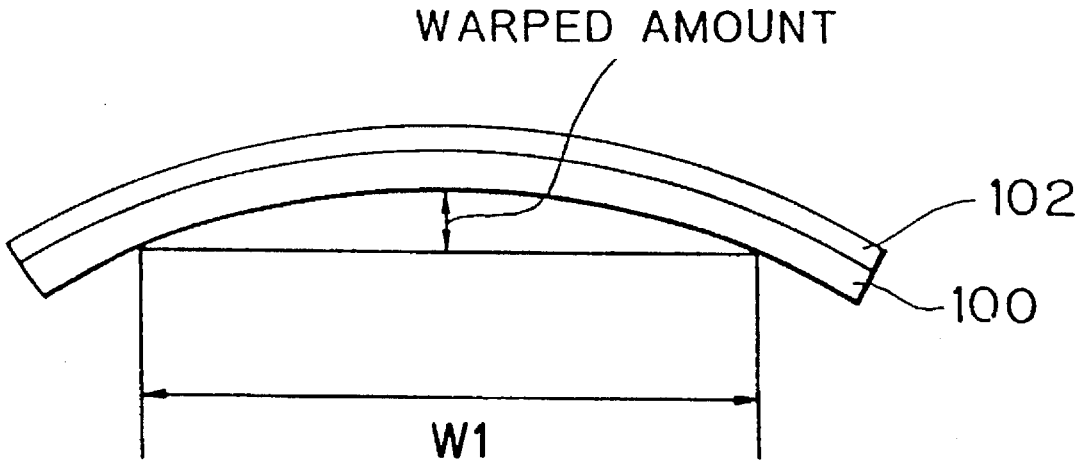
FIG. 7 is a conceptional view showing how to measure the warped amount of a substrate (wi=200 mm).

As for the examples 8 and 9, and the comparative examples 1, 3 and 4, the measurements for the warped amount of the substrate were made by using a projector at the times when the heat storing layer was completed, when the heater board was completed, and when the recording head was completed, wherein the warped amount of the substrate having a length of 200 mm as shown in FIG. 7 was obtained. Their results are listed in Table 6.

TABLE 5

| | Peeling of heat storing layer from substrate |
|---|---|
| Ex. 1 | None |
| Ex. 2 | None |
| Ex. 3 | None |
| Ex. 4 | None |
| Ex. 5 | None |
| Ex. 6 | None |
| Ex. 7 | None |
| Ex. 8 | None |
| Ex. 9 | None |
| Comp. ex. 1 | Present |
| Comp. ex. 2 | Present |
| Comp. ex. 3 | Present |
| Comp. ex. 4 | None |

TABLE 6

| | Warpage/μm when heat storing layer is completed | Warpage/μm when heater board is completed | Warpage/μm when head is completed |
|---|---|---|---|
| Ex. 8 | 55 | 80 | 105 |
| Ex. 9 | 65 | 95 | 115 |
| Comp. Ex. 1 | 550 | 900 | 1100 |
| Comp. Ex. 3 | 850 | 1250 | 1400 |
| Comp. Ex. 4 | 65 | 85 | 105 |

From Table 6, no peeling of the heat storing layer was confirmed in the examples 1 to 9, like the comparative example 4 using a silicon substrate, but some peeling of the heat storing layer was confirmed in the comparative examples 1 to 3. Accordingly, in the present invention, it is possible to form a relatively thick heat storing layer even when the metallic substrate is used.

As indicated in Table 7, the examples 8 and 9, like the comparative example 4 using a conventional silicone substrate, had no problems in the fabrication process, because the warped amount of the substrate when the heater board was completed was 100 μm or less. Also, since the warped amount of the completed recording head was as large as about 100 μm, there was no great effect on the printing. Even when the print performance is affected, the warpage of such extent can be corrected mechanically, causing no specific problem. On the contrary, in the comparative examples 1 and 3, the warped amount of the substrate when the heater board was completed was 500 μm or greater, so that there occurred several problems in the fabrication process of not permitting installation on the jig or adsorption by vacuum chuck. Also, the warped amount when the recording head was completed was so large in the order of 1000 μm or greater that the print performance was especially bad. Further, the mechanical correction was substantially impossible as there would occur some problems such as breakage of liquid channels. From this respect, it would be found that the constitution of the ink jet recording head according to the present invention is significantly effective.

While in this embodiment the substrate material used aluminum or copper, it should be noted that besides these, the materials having excellent surface property may be used.

While in this embodiment the ion implantation with oxygen ions was exemplified, it should be noted that the ion implantation with nitrogen ions is possible under the same conditions.

While in this embodiment the sputter power was changed at steps to change the composition of the heat storing layer, it should be noted that the sputter power may be changed continuously in a gradual manner to change the composition continuously.

Further, while polyimide was used as the stress relief layer, it should be noted that any one of the materials having great elastic modulus and capable of withstanding the film formation temperature in the post-process may be used.

The present invention brings about excellent effects particularly in a recording head or a recording device of the ink jet recording system which forms minute ink droplets with the heat energy for performing the recording among the various ink jet recording systems.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type.

Briefly stating this recording system, by applying at least one driving signal which gives rapid temperature elevation exceeding nucleus boiling to cause film boiling corresponding to the recording information on electricity-heat converters arranged corresponding to the sheets or liquid channels holding a liquid (ink), heat energy is generated to effect film boiling at the heat acting surface of the recording head. Consequently, the bubbles within the liquid (ink) can be formed corresponding one by one to the driving signals to be supplied to the electricity-heat converters. Hence, the on-demand type of recording is particularly effective. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic. As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of U.S. Pat. No. 4,558,333 or 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application No. 59-138461 which discloses the constitution having the opening for absorbing pressure wave of heat energy correspondent to the discharging portion.

Further, the recording head to which the present invention is effectively applied includes a recording head of the full line type having a length corresponding to the maximum width of a recording medium which can be recorded by the recording device. Such a full-line type recording head may be either of the constitution which satisfies its length by a combination of a plurality of recording heads as disclosed in the above specifications, or the constitution as one recording head integrally formed.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform preliminary mode which performs discharging separate from recording.

As the recording mode of the recording device, the present invention is extremely effective for not only the recording mode only of a primary color such as black, etc., but also a device equipped with at least one of plural different colors or full color by color mixing, whether the recording head may be either integrally constituted or combined in plural number.

In addition, though the ink is considered as the liquid in the embodiments as above described, the present invention is effective for the ink which is solid at room temperature as well as the ink which will soften at room temperature. It is only necessary that the ink will become liquid when a recording enable signal is issued as it is common with the ink jet device to control the viscosity of ink to be maintained within a certain range of the stable discharge by adjusting the temperature of ink in a range from 30° C. to 70° C.

In addition, it is also possible to avoid the excessive temperature elevation of the head or ink due to heat energy by positively utilizing the heat energy as the energy for the change of state from solid to liquid, or to prevent the evaporation of ink by using the ink which will stiffen in the shelf state. In either case, the use of the ink having a property of liquefying only with the application of heat energy, such as liquefying with the application of heat energy in accordance with a recording signal so that liquid ink is discharged, or may solidify prior to reaching a recording medium, is also applicable in the present invention.

In such a case, the ink may be held as liquid or solid in recesses or through holes of a porous sheet, which is placed opposed to electricity-heat converters, as described in Japanese Laid-Open Patent Application No. 54-56847 or No. 60-71260.

The most effective method for the ink as above described in the present invention is based on the film boiling.

What is claimed is:

1. An ink jet recording head comprising:

a substrate mainly composed of metal;

a heat resistant resin layer provided on said substrate;

an insulative heat accumulation layer for accumulating thermal energy used for discharging ink, said accumulation layer provided on said heat resistant resin layer; and an energy generating element provided on said heat accumulation layer to generate the thermal energy.

2. A method for fabricating an ink jet recording head comprising the steps of:

immersing a substrate mainly composed of metal in a chemical conversion treatment solution selected from the group consisting of (a) an acid solution containing chromate, phosphate and fluoride, (b) an aqueous solution of sodium carbonate anhydride and sodium chromate anhydride, and (c) an aqueous solution of sodium carbonate, sodium chromate and sodium silicate, the chemical conversion treatment solution reacting with the substrate to form an insulating chemical conversion coating on a surface of the substrate to provide a heat storing layer;

sequentially forming a heat generating resistive layer and an electrode layer on the heat storing layer;

forming a desired circuit pattern on the electrode layer by photolithography to provide a heat acting portion; and forming a protective layer on the heat acting portion.

3. A method for fabricating an ink jet recording head according to claim 2, wherein the heat storing layer is equal to or more than 1 μm.

4. A method for fabricating an ink jet recording head according to claim 2, wherein the substrate comprises aluminum or copper.

5. A method for fabricating an ink jet recording head comprising the steps of:

forming an insulating heat storing layer by ion implantation with oxygen ions or nitrogen ions on a substrate mainly composed of metal;

sequentially forming a heat generating resistive layer and an electrode layer on the insulating heat storing layer;

forming a desired circuit pattern on the electrode layer by photolithography to provide a heat acting portion; and forming a protective layer on the heat acting portion.

6. A method for fabricating an ink jet recording head according to claim 5, wherein the heat storing layer is equal to or more than 1 μm.

7. A method for fabricating an ink jet recording head according to claim 5, wherein the substrate comprises aluminum or copper.

* * * * *